United States Patent [19]

Brull et al.

[11] Patent Number: 4,655,625

[45] Date of Patent: Apr. 7, 1987

[54] SINGLE STATION PRINTER FOR PRINTING ON PLURAL RECORD MEDIA

[75] Inventors: Robert A. Brull, Dryden; Alan H. Walker, Barton; Joseph C. Moro, Ithaca, all of N.Y.

[73] Assignee: NCR Corporation, Dayton, Ohio

[21] Appl. No.: 776,728

[22] Filed: Sep. 16, 1985

[51] Int. Cl.[4] ..... B41J 15/20

[52] U.S. Cl. ..... 400/605; 400/57; 400/58; 400/606; 400/645.2; 400/647.1; 400/703

[58] Field of Search ..... 400/266, 266.1, 266.2, 400/266.3, 506, 521, 605, 606, 607, 607.2, 607.3, 608, 608.1, 608.2, 608.3, 642, 643, 645, 645.1, 645.5, 647, 647.1, 23, 29, 43, 44, 55, 56, 57, 58, 59, 645.2, 703

[56] References Cited

U.S. PATENT DOCUMENTS

| | | | |
|---|---|---|---|
| 790,283 | 5/1905 | Brooks | 400/266.1 |
| 1,302,278 | 4/1919 | Barlow et al. | 400/608.1 |
| 1,492,670 | 5/1924 | Brown | 400/608.1 |
| 1,619,858 | 3/1927 | Gage | 400/644 |
| 1,739,729 | 12/1929 | Muggli | 400/608.1 |
| 2,102,694 | 12/1937 | Garbell | 400/607 |
| 2,841,265 | 7/1958 | Uhlig | 400/608.1 |
| 3,776,341 | 12/1973 | Dobner et al. | 400/57 |
| 4,074,797 | 2/1978 | Lewis et al. . | |
| 4,227,819 | 10/1980 | Manriquez | 400/56 |
| 4,229,113 | 10/1980 | Anderson et al. | 400/596 |
| 4,302,116 | 11/1981 | May et al. | 400/642 |
| 4,439,051 | 3/1984 | Lawter | 400/605 |
| 4,451,168 | 5/1984 | Greenhaw et al. | 400/645 |
| 4,586,839 | 5/1986 | Iwagami | 400/642 |

FOREIGN PATENT DOCUMENTS

| | | | |
|---|---|---|---|
| 369304 | 2/1923 | Fed. Rep. of Germany | 400/266 |
| 2533202 | 2/1976 | Fed. Rep. of Germany | 400/58 |

*Primary Examiner*—Edgar S. Burr
*Assistant Examiner*—David A. Wiecking
*Attorney, Agent, or Firm*—Wilbert Hawk, Jr.; Albert L. Sessler, Jr.; George J. Muckenthaler

[57] ABSTRACT

A slip/receipt printer is provided with a separator bracket attached at one side thereof to a forms compensating arm in cantilever manner. The separator bracket is biased by magnetic means toward the arm to provide a precise path for receipt paper. A slip or form is inserted into the printer on the top surface of the separator bracket. The separator bracket separates the receipt paper from the slip or form. Openings are provided in the separator bracket and other record medium supports.

14 Claims, 4 Drawing Figures

SINGLE STATION PRINTER FOR PRINTING ON PLURAL RECORD MEDIA

CROSS REFERENCE TO RELATED APPLICATION

Record Media Thickness Compensating Mechanism, co-pending application Ser. No. 776,243, invented by Robert A. Brull, Alan H. Walker and William V. McFall and assigned to NCR Corporation.

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical derived system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and journal printing operation, the print head structure may be a multiple element type and horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form, slip or like media while the carriage and print head are moved above and across the form or media in the horizontal direction.

Alternatively, the print head may be supported and guided along a line of printing wherein the form or record media is placed on edge and the print head is caused to be driven in a vertical direction for the printing operation.

Further, the printer structure may be an arrangement which includes a plurality of equally-spaced, horizontally-aligned, single element print heads which are caused to be moved in back and forth manner to print successive lines of dots in making up the lines of characters. In this latter arrangement, the drive elements or transducers are individually supported along a line of printing. Dependent upon the printer type, the horizontally-aligned, single element print heads may be either horizontally or vertically oriented in the axial direction for printing operation. These single wire actuators or solenoids are generally tubular or cylindrically shaped and include a shell which encloses a coil, an armature and a resilient member arranged in manner and form wherein the actuator is operable to cause the print wire to be axially moved a small precise distance in dot matrix printing.

In the case of a wire matrix printer which is utilized for form or multi-copy printing, the difference in thickness of the forms or copies may require some means or mechanism for adjusting the gap or the distance between the print head and the printer platen. It is in the field of printing in dual function manner at a single print station, the dual function including receipt printing and printing on business forms or like record media, that the subject matter of the present invention is most closely associated and which provides for improved and advantageous positioning and control of receipt paper and slips or forms during the printing operation.

Representative documentation in the field of wire matrix print heads used for printing on receipts and forms or like record media includes U.S. Pat. No. 4,074,797, issued to K. R. Lewis et al. on Feb. 21, 1978, which discloses a single station, plural function printer providing selective driving or feeding of at least two printing media wherein drive members are arranged in overlapping manner with individual control of such drive members. The plural functions include printing on receipt and/or journal paper and also on a slip or form that is driven by means of a swingable member.

U.S. Pat. No. 4,227,819, issued to R. F. Manriquez on Oct. 14, 1980, discloses a printer having a receipt station, an audit station and a form station, and a platen assembly for feeding and holding single or multi-layer record media and having one of a pair of feed rollers pivotally mounted to yieldingly engage and hold both sides of the record media while the platen yieldingly engages and holds the record media against gap determining guides. The platen is free floating with the aid of a pair of coil springs and is raised into engagement with the record media by rotatable cam means.

U.S. Pat. No. 4,229,113, issued to T. H. Anderson et al. on Oct. 21, 1980, discloses a shared document feed station for receipt and journal printing and including a common drive mechanism for normally advancing receipt paper and for selectively advancing journal paper with document detectors for sensing presence of a document.

U.S. Pat. No. 4,439,051, issued to R. L. Lawter on Mar. 27, 1984, discloses a rotatable platen carried on a pivoted arm and including solenoid means with spring loading for multi-form documents. A single drive mechanism provides selective feeding of at least two printing media and independent bi-directional movement of the media. The drive mechanism allows the two printing media to be positioned in the print station for a printing operation, and a pivotal deflector member, rotated in one or the other direction by the platen, is provided to deflect the leading edge of the receipt paper in an upward direction.

SUMMARY OF THE INVENTION

The present invention relates generally to impact type printers which have the capability of printing on at least two types of record media. More particularly, the present invention relates to means for positioning the printer platen and an associated media drive roller in a manner to provide a path past the printer mechanism for receipt or journal paper, and for form or slip type media. The record media may be a single layer sheet or a variety of multilayer forms, any of which may be of different or greater thickness than other media.

A media thickness compensating arm assembly is pivoted from a predetermined position relative to the printing station for supporting the printer platen so as to enable moving the platen in a direction toward and away from the print head. A solenoid-operated cam line, operably associated with and forming a part of the overall compensating assembly, is caused to be rotated in one direction to allow insertion of the form or like media in the gap between the platen and the print head, and the cam line is then caused to be rotated in the other direction to position the platen and the form for printing operation.

A second cam line is operably associated and connected with the first mentioned solenoid-operated cam line wherein the second cam line is rotated to hold the platen and the form in position during the printing operation. The platen is resiliently supported and the second cam line utilizes the benefit of over-centering means engageable with the platen for retaining and holding same in printing position.

More specifically, a second arm assembly including a record media drive or feed roller is interconnected with the forms compensating arm assembly through the use of pivot pins operating in a slot and located at a position between the platen and the media drive roller so as to provide a one-to-one ratio between the pressure-drive roller gap and the print head-platen gap. The second arm assembly is pivoted from a predetermined position relative to the printing station for supporting the media feed roller so as to enable moving the feed roller toward and away from the pressure roller.

A separating mechanism for the two types of media is included in the printer to enable providing a precise path for each media past the printing station. The mechanism includes a plate or bracket which is secured at one side thereof to the forms compensating arm and extending thereacross in cantilever manner.

The plate or bracket is normally held in a downward position over the forms compensating arm by means of a permanent magnet attached to the arm. Receipt paper is loaded into the printer by lifting the plate or bracket and transporting or feeding the paper in a path between the compensating arm and the bracket. A form or slip is inserted over the top surface of the bracket and then transported to the printing station for printing thereon over the receipt paper.

In view of the above discussion, the principal object of the present invention is to provide a compact printing mechanism in a business machine.

Another object of the present invention is to provide a single printing station for accommodating a plurality of printing transactions.

An additional object of the present invention is to provide paper drive mechanism occupying limited space for dual printing functions and for moving the media past a single printing station.

A further object of the present invention is to provide paper drive mechanism for moving the paper independently in a bi-directional path for the plural printing functions.

Still another object of the present invention is to provide a first supporting member for the platen to effect a gap with the print head, and means operably connected with the first supporting member for separating different types of record media.

Still a further object of the present invention is to provide a separating bracket attached to one side of the first supporting member for effecting a path for each of the record media utilized in the printing operations.

Additional advantages and features of the present invention will become apparent and fully understood from a reading of the following description taken together with the annexed drawing.

DESCRIPTION OF THE PREFERRED EMBODIMENT

Prior to describing the structure in detail, it should be noted that the printer, for use in certain operations and/or environments, may be termed a slip/receipt printer. The printer is capable of printing in at least dual manner or providing dual printing functions with a single printing mechanism operating at one station, such dual functions including receipt printing and slip validation. The slip or like record media is normally thicker than a single sheet of paper or it may include a plurality of sheets making up a multiple part form.

Figure 1:
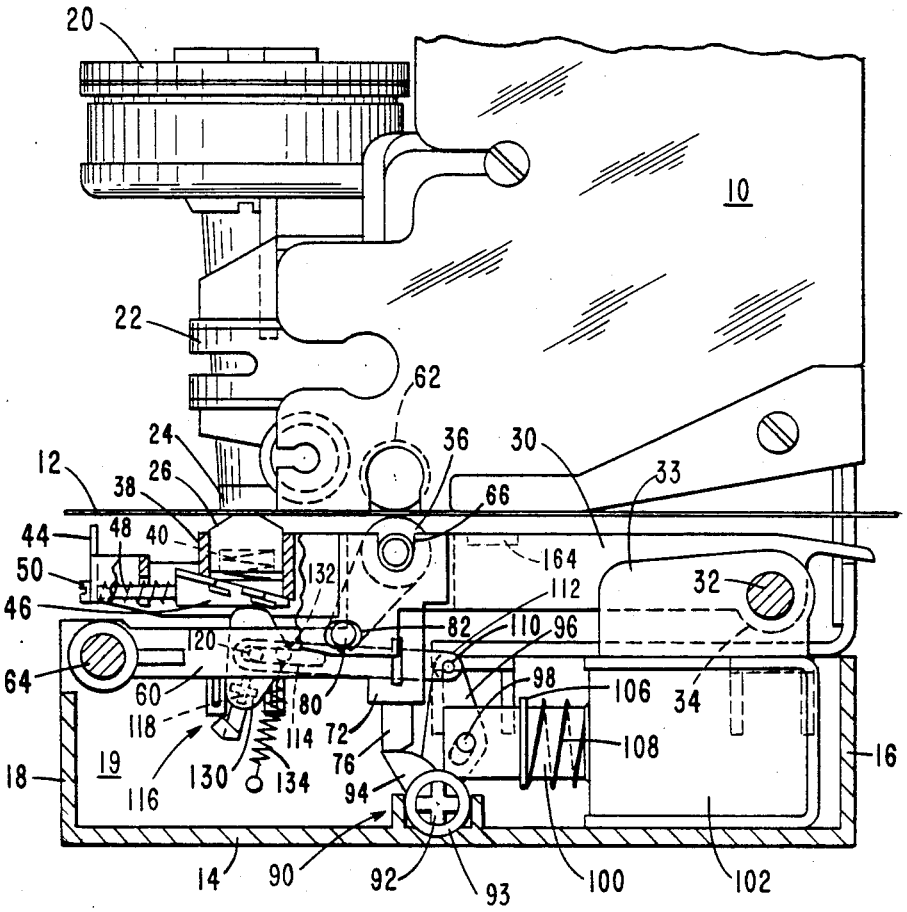
FIG. 1 is an elevational view, partly in section, of a printer incorporating the subject matter of the present invention and illustrating the parts in a printing position.

Referring now to FIG. 1, there is shown an elevational view of a printer, generally designated as 10, and as viewed from the front thereof by an operator, and oriented for operation in horizontal manner, wherein record media in the nature of a business form 12 enters in a direction from the right side. While the printer 10 of FIG. 1 is illustrated for form or slip printing operation it is understood, of course, that the subject matter of the present invention may likewise be utilized in an arrangement, wherein thick paper or multi-layer paper may be supplied from a paper roll (not shown) and placed in like orientation for printing thereon.

A frame member 14 serves as a base for the printer and has a first or angled portion 16, and a second portion 18 wherein the first portion provides a right wall and the second portion provides a left wall, the overall structure forming a bucket type frame for the various parts. It is noted at the outset that the main frame structure is made of plastic which may be of clear material and may be molded in one piece. As an example, the frame member portions 14, 16 and 18 are molded in one piece and may be formed for access to certain of the interior parts of the printer. A front wall (not shown) and a rear wall 19 (FIG. 1) complete the housing for the lower portion of the printer 10.

The printing mechanism utilizes a dot matrix print head 20 of well-known type which is suitably supported from a carriage 22 for reciprocal motion (along a path in the direction of viewing) in printing operation. The operating end 24 of the print head is positioned in opposed manner relative to a platen 26 supported in horizontal manner from the printer.

Figure 3:
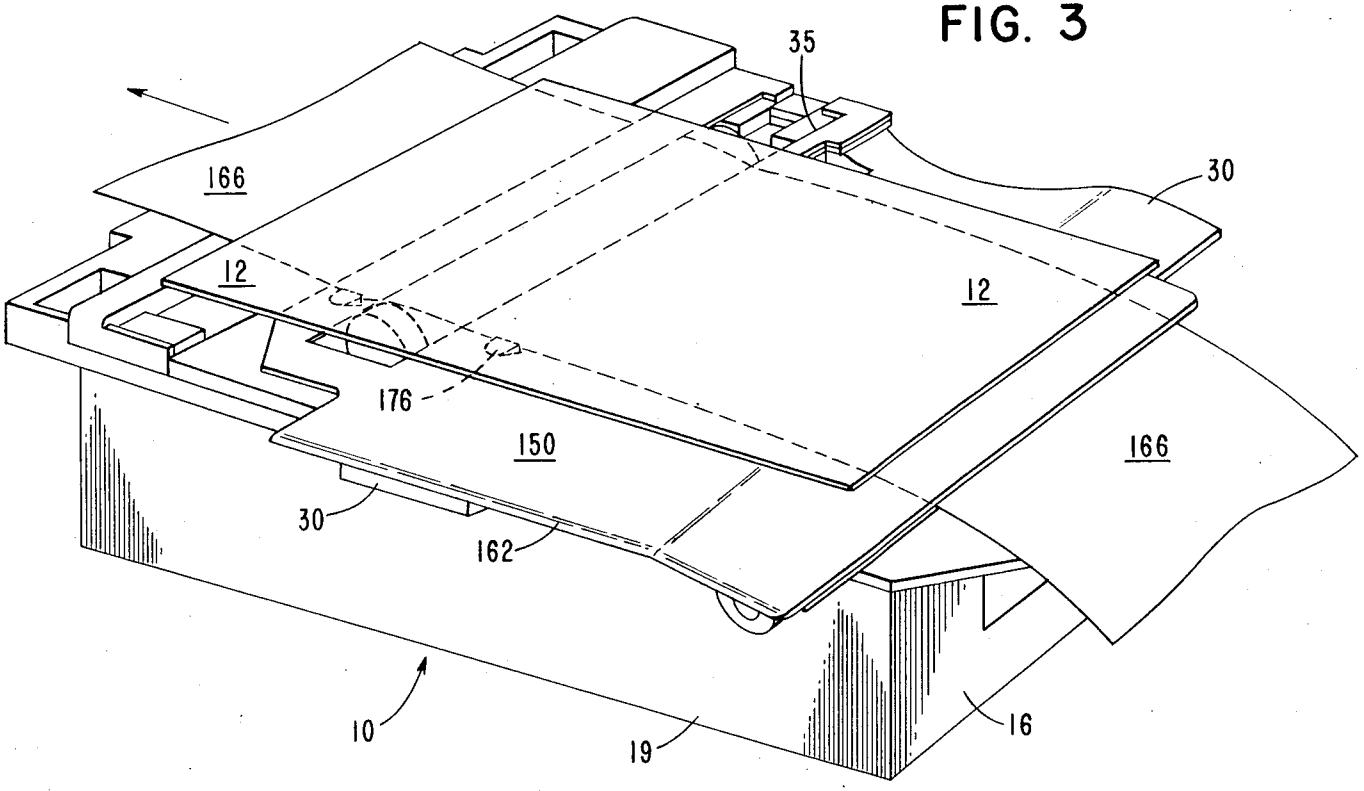
FIG. 3 is a perspective view of certain mechanism within the printer of FIG. 1.

The printer 10 includes a forms compensating assembly wherein a support structure or member 30, in the nature of a first or forms compensating arm, is pivotable on a forms compensating arm shaft 32 journaled in a cantilever-type bracket 33 (FIG. 1) connected to suitable side frame members of the printer. The support member or arm 30 is preferably molded in a single piece and includes bearing portions, as at 34, forming journals for the shaft 32. The support arm 30 is pivoted at shaft 32 and extends toward the left in FIG. 1 and includes a slot 35 therein (FIG. 3) for accommodating a feed roller 36. The support arm 30 has an end portion or trough 38 (FIG. 1) for housing the platen 26. A pair of coil springs, as at 40, are placed against one surface of the trough 38, one spring at each end thereof and resiliently support the flat metal platen 26. The platen 26 is adjusted by means of two screws and lock nuts (not shown) at the ends of the platen, which screws are located perpendicular to and pass through the platen into two holes (not shown) located in the support arm 30. The lock nuts are justified to the underside of the arm 30.

The support arm 30 further includes a generally square end portion, as at 44, (FIG. 1) which extends substantially the length of the trough 38 and supports a pair of latching camshaft adjusting ramps, as at 46, such ramps being fitted with the trough and movable thereunder. The ramps 46 are adjustably moved by means of a spring 48 and screw 50 arrangement to provide a means for adjusting an initial locking torque between a latching camshaft assembly (later described) and the flat area just below the trough portion 38 of the forms compensating arm 30 which supports the platen 26. The entire forms compensating arm assembly 30 swings about the shaft 32.

Figure 2:
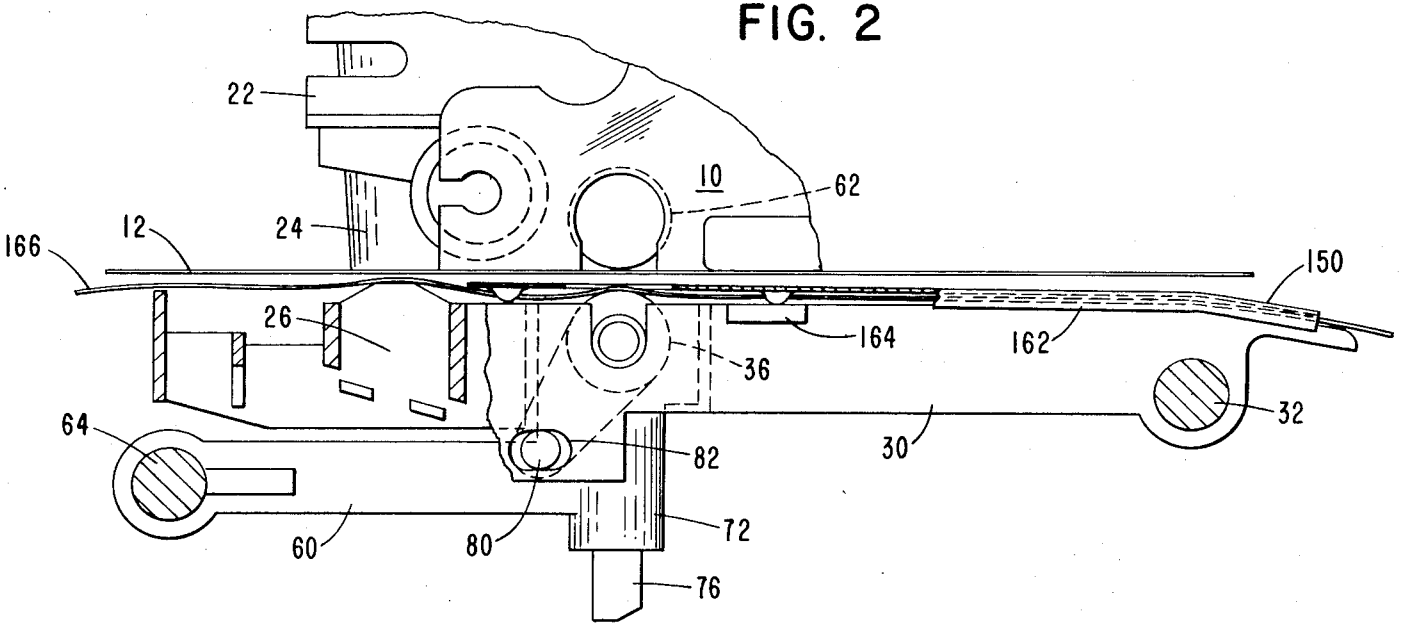
FIG. 2 is an enlarged view of certain mechanism shown in FIG. 1.

A second supporting arm assembly, generally indicated as 60, see also FIG. 2, is provided to effect difference or variation in the gap between the feed roller 36 and an associated pressure roller 62. The arm assembly 60 is pivoted on a shaft 64 journaled in the printer frame and provides suitable bearing blocks or supports, as at 66, for the feed roller 36. The entire feed roller arm assembly 60 swings about the shaft 64.

A pair of cylindrically-shaped members, as at 72, are formed integral with the arm assembly 60 and each of the members 72 contains a spring therein (not shown) for biasing a pin or plunger 76 in a downward direction.

The first supporting arm assembly 30 and the second arm assembly 60 are interconnected at a point between the area of contact between the feed roller 36 and the pressure roller 62 and the area of contact between the platen 26 and the print head 20, by means of a lost motion-type connection formed by a pin 80 and slot 82 arrangement. The slots 82 are formed or molded into the arm assembly 30 and the pins 80 are molded on the arm assembly 60. The adjusting ramps 46, the arm assembly 30 and the arm assembly 60 are interconnected by means of the pin 80-slot 82 arrangement. The location of these pins 80 and slots 82 in conjunction with the length of each of the arms 30 and 60 creates a one-to-one ratio of the gap or opening between the platen 26 and the print head 20 and the feed roller 36 and the pressure roller 62.

A forms compensating camshaft assembly, generally designated as 90, (FIG. 1) is operably associated with the arm assembly 60 and includes an irregular or X-shaped cross-section shaft 92 suitably journaled at the ends and mounted in bearings 93 placed into the frame portion 14 of the printer 10. The shaft 92 includes a pair of cam lobes, as at 94, which may be formed by use of polynomial expression and which are positioned to engage with the spring-urged pins or plungers 76 captured within the cylindrical members 72. A centrally-located, integrally formed link member 96 of the shaft 92 is connected to an armature or plunger 100 by means of a clevis pin 98 carried thereon. The armature or plunger 100 forms part of a latching solenoid 102 suitably secured to or supported from the frame portion 14 of the printer 10. The solenoid armature 100 is loaded in one direction for return travel by a coil spring 108 operating against a washer 106.

The centrally-located link member 96 is pivotally connected at pivot 110 to a link 112 (FIG. 1) having slots, as at 114, in the sides thereof for slidably connecting with a second cam assembly, generally designated as 116. The cam assembly 116 also includes an irregular or X-shaped cross-section shaft 118 which is suitably journaled in a portion of the printer frame. The shaft 118 for the cam assembly 116 has a double-sided member (not shown) as an integral portion at the center thereof with pins, as at 120, slidable in a lost motion-type connection with the slots 114 in the link 112. The shaft 118 for the cam assembly 116 also includes at each end thereof a multi-sided plate-like member 130 as an integral part thereof and extending generally in an up and down direction under the ramps 46 supporting the platen 26. Each of the members 130 has a small projection, as at 132, extending outwardly beyond the ends of the cam assembly shaft 118, and a coil spring 134 is connected to each projection and to an appropriate anchor in the frame portion 14 of the printer 10 to provide a rotational bias on the plate members 130. Further, the spring 134 biases the shaft 118 along with the members 130 in an over-center position or condition, as illustrated in FIG. 1.

In the operation of the forms compensating mechanism of the present invention, it is desirable that the mechanism accommodate record media of different thicknesses and also provide a firm support for the media during the printing operation. In this regard, the thickness of the record media 12 determines the gap or opening between the feed roller 36 and the pressure roller 62 and the gap or opening between the platen 26 and the print head 20, which gaps are substantially equal as provided by the shown and described structure.

In FIG. 1, which illustrates the operating or printing position of the parts, the armature or plunger 100 is inward toward the solenoid 102 in a condition wherein the shaft 92 along with the cam lobes 94 are rotated in a clockwise direction through the clevis pin 98 connection of the armature 100 with the link member 112 which action moves such cam lobes 94 clockwise and raises the pins 76 along with the cylinders 72. The forms compensating arm assembly 30 and the feed roller arm assembly 60 are swung upwardly in clockwise and counterclockwise directions, respectively, to effect substantially the same gap between the pressure roller 62 and the feed roller 36 and also between the platen 26 and the tip 24 of the print head 20 for entry of the record media 12. While the initial gap between the platen 26 and the print head 20 is set without any media between the pressure roller 62 and the feed roller 36, the forms compensating mechanism will automatically maintain the same gap therebetween for different thicknesses of the various media. Depending upon the thickness of the media, the spring-loaded pins or plungers 76 in cylindrical members 72 are lowered to provide or apply the proper loading between the feed roller 36 and the pressure roller 62 for smoothly advancing the media 12 to the printing station.

When the form or other media 12 is in position for printing thereon, the solenoid 102 is energized and the armature or plunger 100 is retracted or moved to the right, as illustrated in FIG. 1. The camshaft assembly 90 is rotated in the clockwise direction and such motion causes engagement of the cam lobes 94 on the shaft 92 with the spring-loaded pins 76 and swings the forms compensating arm assembly 30 along with the platen 26 toward the print head 20, and the feed roller arm assembly 60 along with the feed roller 36 toward the pressure roller 62. When the solenoid 102 is energized, the camshaft assembly 90 is rotated into position, and at the same time, the solenoid is latched and power is turned off. The solenoid 102 includes a pull coil and a return coil in its circuitry for proper operation. When the camshaft assembly 90 is rotated, the forms compensating arm assembly 30 and the feed roller arm assembly 60 are swung upwardly until contact is made between the feed roller 36 and the pressure roller 62. The forms compensating camshaft assembly 90 continues to rotate until the solenoid plunger bottoms. To compensate for additional travel required by the camshaft 92, the plungers 76 are pushed upwardly into the members 72 and apply the required load between the feed roller 36 and the pressure roller 62 on the media 12. The link 112 connecting the first camshaft 92 and the second or latching camshaft 118 is moved by the member 96 and causes the second camshaft to be rotated to an overcenter position, as seen in FIG. 1, and as set and held by the springs 134. In this manner, the members 130 at the ends of the latching camshaft 118 are rotated to tightly engage with the adjusting ramps 46 mounted in arm 30, thus providing a firm base or support for the printing operation.

As briefly alluded to earlier, FIG. 1 is a view illustrating a horizontal orientation of the forms compensating mechanism. This view shows the pivot shaft 32 along with the camshaft 92 for carrying the cam lobes 94 at the ends thereof and for engaging with the pins 76 of the cylindrical members 72 for raising the platen 26 and feed roller 36 assemblies upon energization of the solenoid 102. Further, FIG. 1 shows the second or latching camshaft 118 with the plate members 130 at the ends thereof for engaging with the underside of the ramps 46 supporting the arm 30.

Figure 4:
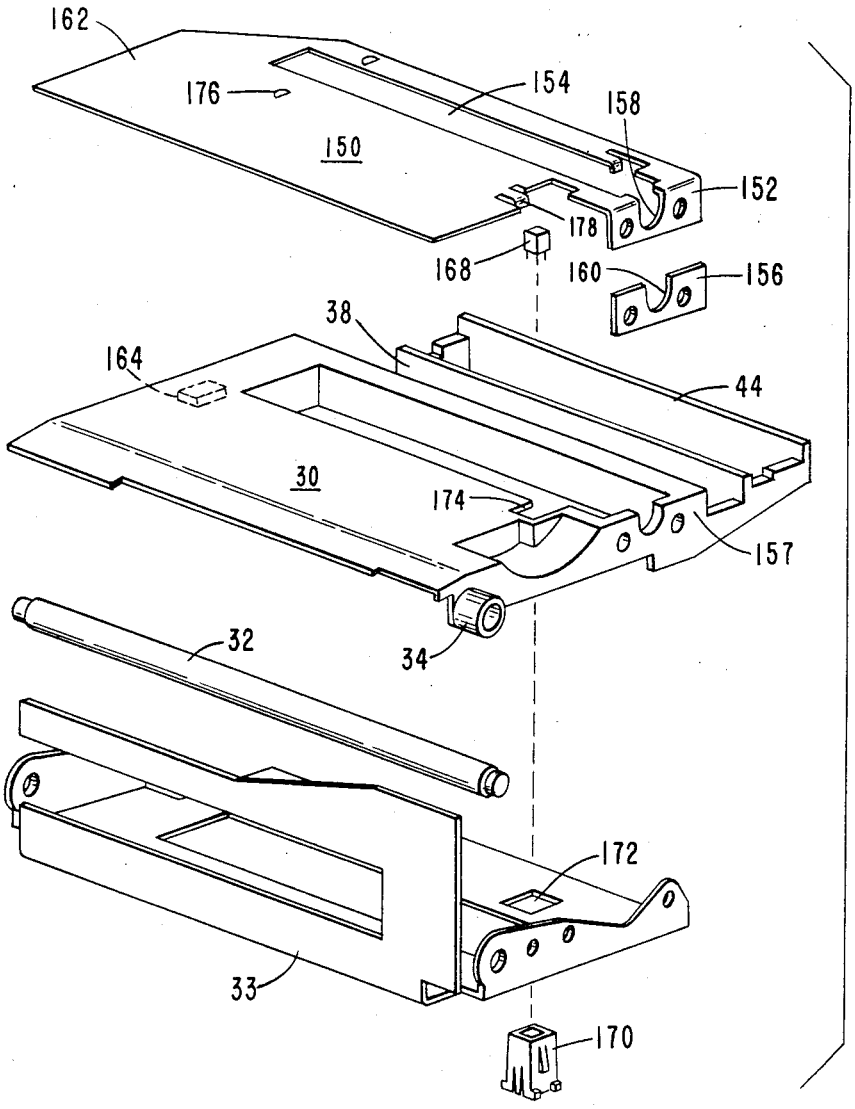
FIG. 4 is an exploded view of certain parts of the present invention.

The present invention provides a separator bracket 150 (FIGS. 2 and 3) formed of plate-like construction and including an angle portion 152 at one side thereof, as shown in the exploded view of FIG. 4, for connection to the forms compensating arm 30. The plate member 150 has a slot 154 formed therein for receiving the feed roller 36 in position for driving the record media. A small rectangular support member 156 is provided to attach the bracket 150 to the arm 30 at arm portion 157 by suitable screws. The separator bracket 150 has a curved cutout 158 in the angle portion 152 and the member 156 has a similar curved cutout 160 for receiving the feed roller 36.

The separator bracket 150 is carried or supported from the arm 30 in cantilever manner or fashion over the surface of the arm at a spacing of approximately one and one-half to two millimeters. The separator bracket 150 includes a tab portion 162 extending beyond the arm 30 (FIG. 3) and the tab portion is held or biased in a downward direction by means of a permanent magnet 164 (FIG. 1) suitably mounted on the underside of the arm 30.

The receipt paper 166 is loaded into the printer 10 by lifting the tab portion 162 upwardly a sufficient amount to separate the magnetic force of the magnet 164 holding the bracket 150 in a downward or normally operating position.

An optical sensor 168 (FIG. 4) is provided in the printer 10 for detecting the presence of a slip 12 inserted along a path on top of the separator bracket 150. The sensor 168 is placed in a mount 170 which is snapped into an opening 172 in the bracket 33. The top of the sensor 168 is located just below the top surface of the bracket 150 for permitting sliding a form 12 thereover in the arrangement for detecting the presence of the form. An opening 174 is provided in arm 30 as clearance for the sensor mount 170. The slip 12 (FIG. 2) can be printed in its position over the receipt paper 166 and the media drive mechanism is utilized to drive or advance both the slip and the receipt.

In the operation of the dual function printer, the tab portion 162 of the separator bracket 150 is raised an amount sufficient to release the bracket from the magnetic force of the magnet 164 to enable insertion of the receipt paper 166 under the bracket 150 and over the surface of the forms compensating arm 30. The receipt paper 166 is controlled in a precise path by means of bent tabs or dimples 176 (FIGS. 3 and 4) on the inside of the bracket 150 and by means of partial sheer ledges 178 (FIG. 4) on the outside of the bracket. This controlled path of the receipt paper 166 is extremely important to the operation of the dual functionality of the printing mechanism by directing the receipt paper away from the form sensor 168 and providing for proper receipt paper guidance during slip or form feeding operations.

After the receipt paper 166 is inserted under the separator bracket 150, a slip or form 12 can be inserted at the right side of the printer (FIG. 1) and can be slid over the top surface of the arm 30 in a path whereby the presence of the slip or form is sensed by the sensor 168 (FIG. 4). The feed roller 36-pressure roller 62 drive mechanism advances both the receipt paper 166 and the slip 12 into position for the printing operation, as illustrated in FIG. 2. When printing is completed, the drive mechanism is reversed and the slip 12 and the receipt paper 166 are returned to a position to the right of the print head 20 (FIG. 1). The receipt paper return is controlled by the separator bracket 150 which maintains an even guided transition for the paper to be returned to a paper supply (not shown) without buckling or jamming within the printer mechanism. The printer throat or gap is reopened and the slip 12 can be removed, thus leaving the receipt paper 166 in position for the next transaction. The entire mechanism is returned to such reopened position when a voltage is applied to the return coil, thereby neutralizing the magnets in the solenoid 102.

It is thus seen that herein shown and described is a single station, dual function printer which enables the use of a single print head movable across such single station for one or more printing transactions. The printer includes separating means for providing passageways for two different types of record materials and for guiding such record materials past the printing station. The record material separating means and the forms compensating means provide for a compact, cost effective, single station, dual function printer. The mechanism and arrangement enable the accomplishment of the objects and advantages mentioned above, and while a preferred embodiment of the invention has been disclosed herein, variations thereof may occur to those skilled in the art. It is contemplated that all such variations not departing from the spirit and scope of the invention hereof are to be construed in accordance with the following claims.

We claim:

1. A mechanism for providing passageways for a plurality of record materials past a single printing station in a printer haivng a platen and an opposing print head, the mechanism comprising means including a drive roller and a driven roller for advancing said record materials toward the printing station, support means pivotally connected to the printer and having a generally horizontal top surface for guiding one of said record materials past the printing station, separator means connected to said support means and spaced therefrom to provide a passageway for said one of said record materials between the top surface of the support means and the separator means, the separator means extending above the support means in cantilever manner and having a generally horizontal top surface for guiding another of said record materials past the printing station, said support means and said separator means each including a plate member defining a slot therein for receiving said drive roller, said separator means plate member including guide means thereon spaced to maintain said one of said record materials in a controlled path toward the printing station, and means for holding the separator means plate member in one position for supporting said another of said record materials and allowing the separator means plate member to be raised from the support means plate member for receiving said one of said record materials.

2. The mechanism of claim 1 wherein said support means plate member has one end portion pivotally connected to the printer and another end portion providing a housing for supporting the platen.

3. The mechanism of claim 1 wherein said holding means comprises a permanent magnet secured to the support means.

4. The mechanism of claim 1 wherein said separator means plate member includes an angle portion for connecting with the support means.

5. In a printer having a print head movable across a printing station for printing on a plurality of record materials representing different types of records, means including a drive roller for advancing the record materials to enable printing on the record materials, the improvement comprising an arm assembly including a plate member pivotally supported at one end thereof to provide a print head gap and having a generally horizontal surface for guiding one of said record materials past the printing station, and separator means comprising a plate member secured to the arm assembly and spaced therefrom to provide a passageway for said one of said record materials between the guiding surface of the arm assembly and the separator means plate member, the separator means plate member extending above the arm assembly in cantilever fashion and having a generally horizontal top surface for guiding another of said record materials past the printing station, said separator means plate member including guide means thereon spaced to accommodate and to maintain said one of said record materials in a controlled path toward the printing station.

6. In the printer of claim 5, also including means for biasing the separator means toward the arm assembly.

7. In the printer of claim 5 wherein the separator means plate member includes an angle portion for connecting with the arm assembly to enable swinging movement of the separator means plate member relative to the arm assembly.

8. In the printer of claim 6 wherein the biasing means comprises a permanent magnet secured to the arm assembly.

9. In the printer of claim 5, also including means connected to the printer for sensing presence of said another record material.

10. A guide mechanism for a plurality of record materials advanced by means of a drive roller past a single printing station in a printer having a platen and a print head operating arrangement, the mechanism comprising a support plate member pivotally connected at one end thereof to the printer and having a generally horizontal surface for guiding one of said record materials in a path past the printing station, said surface defining a slot therein for receiving said drive roller, and a separator plate member connected to said support plate member and spaced therefrom and including guide means thereon spaced to provide a controlled path toward the single printing station for said one of said record materials and said separator plate member extending above the support plate member in cantilever manner and having a generally horizontal top surface defining a slot therein for receiving said drive roller and for supporting another of said record materials in a path past the printing station.

11. The guide mechanism of claim 10 wherein the support plate member comprises an arm having one end portion pivotally connected to the printer and the other end portion providing a housing for supporting the platen.

12. The guide mechanism of claim 10, also including means for holding the separator member in one position for supporting said another record material and allowing the separator member to be raised from the support member for receiving said one record material.

13. The guide mechanism of claim 12 wherein said holding means comprises a permanent magnet secured to the support member.

14. The guide mechanism of claim 10 wherein the separator member includes an angle portion for connecting with the support member.

* * * * *